US011149721B2

(12) United States Patent
Guender et al.

(10) Patent No.: US 11,149,721 B2
(45) Date of Patent: Oct. 19, 2021

(54) HYDRAULIC UNIT

(71) Applicant: Robert Bosch GmbH, Stuttgart (DE)

(72) Inventors: Andreas Guender, Ramsthal (DE); Jan Lukas Bierod, Bad Camberg (DE); Marco Scholz, Burgsinn (DE); Ralf Maier, Neuendorf (DE); Rene Huettl, Chemnitz (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/656,085

(22) Filed: Oct. 17, 2019

(65) Prior Publication Data

US 2020/0124035 A1 Apr. 23, 2020

(30) Foreign Application Priority Data

Oct. 19, 2018 (DE) ..... 10 2018 126 114.4

(51) Int. Cl.
*F04B 17/03* (2006.01)
*F04B 23/02* (2006.01)

(52) U.S. Cl.
CPC ..... *F04B 17/03* (2013.01); *F04B 23/02* (2013.01); *F04B 23/025* (2013.01)

(58) Field of Classification Search
CPC ..... F04B 17/03; F04B 23/02; F04B 23/025
See application file for complete search history.

(56) References Cited

U.S. PATENT DOCUMENTS 5,730,643 A * 3/1998 Bartlett ..... B23Q 11/08 451/11
2010/0089340 A1* 4/2010 Givens ..... F02B 63/04 123/2

OTHER PUBLICATIONS

Figovsky, Oleg and Dmitry Beilin, "Advanced Polymer Concretes and Compounds," Dec. 11, 2013, CRC Press, xiii (Year: 2013).*

* cited by examiner

*Primary Examiner* — Patrick Hamo
(74) *Attorney, Agent, or Firm* — Maginot, Moore & Beck LLP

(57) ABSTRACT

A hydraulic unit having a housing includes a tank and a pump arranged adjacent to one another in a fluid supply region, and a controller region is arranged thereabove. Since the pump is embodied in an upright design, a compact hydraulic unit with a small footprint is implemented.

19 Claims, 6 Drawing Sheets

HYDRAULIC UNIT

This application claims priority under 35 U.S.C. § 119 to application no. DE 10 2018 126 114.4, filed on Oct. 19, 2018 in Germany, the disclosure of which is incorporated herein by reference in its entirety.

The disclosure relates to a hydraulic unit.

BACKGROUND

Hydraulic units which are provided for the hydraulic supply of at least one definable hydraulic consumer, such as the supply of pressure and/or volumetric flow, are known from the prior art. To this end, such a hydraulic unit comprises at least one hydraulic tank and at least one pump subassembly. Typically, such a hydraulic unit also contains a fluid circuit for actuating the consumer, as well as a trough designed for collecting leakage fluid. In a conventional construction of a hydraulic unit for stationary operation, namely for a forming press, a fluid tank of horizontal design, i.e. with the greatest extent in approximately the horizontal plane, is fixed to a collection trough, the pump subassembly is fixed to the fluid tank in a horizontal design, i.e. with an approximately horizontally running main shaft, and a controller comprising the fluid circuit is fixed to the fluid tank and/or the pump subassembly.

This conventional construction principally has the drawback that the horizontally extending design does not correspond to the requirement of a modern factory workshop for a machine footprint which is as small as possible, wherein there is generally no limit to a machine height. Moreover, the conventional construction has a series of further drawbacks: since the hydraulic tank simultaneously fulfils a static load-bearing function in addition to a container function, this is costly and structurally inflexible. The components/subassemblies which are mechanically assembled in series relative to one another impede the serviceability. The components/subassemblies which are mechanically assembled in series relative to one another complicate a modularization/adaptability to the application. The hydraulic tank bearing the further components/subassemblies is excited to vibrate, which also increases undesirable sound emissions; an acoustic optimization of the hydraulic tank requires an even greater material consumption.

SUMMARY

Accordingly, the object of the disclosure is to provide a hydraulic unit with a small footprint. Preferably, the invention fulfils at least one of the additional requirements for easy serviceability, a flexibly adaptable construction, a simplified capacity to be modularized and/or reduced emissions. The invention is also preferably able to be mass-produced and/or able to be used in a typical application.

This object is achieved according to the features disclosed herein.

A hydraulic unit according to the invention is provided for supplying at least one hydraulic consumer with at least one hydraulic tank and a pump subassembly in a fluid supply region.

Preferably, the hydraulic unit is provided for stationary operation, for example for supplying a factory machine. Since the fluid supply region and a controller region are arranged approximately on top of one another and/or approximately vertically, a footprint of the hydraulic unit is kept small. In this case the regions are able to be respectively defined by at least one housing portion, such as a housing part and/or a partial housing. The controller region may be a housing portion which is provided for receiving a controller and/or a controller part, so that it may be adapted to the application. Since the pump subassembly is arranged in an upright design, i.e. with the greatest extent in the vertical direction, such as for example is able to be implemented with an approximately vertically running main axis, only a small footprint is required.

Preferably, the hydraulic tank is also embodied in an upright design, wherein the greatest extent runs approximately vertically, whereby similarly only a small footprint is required. Moreover, the hydraulic tank is preferably arranged adjacent to the pump subassembly in the fluid supply region, so that in each case by means of a design which is independently optimized an arrangement which is compact and space-saving may be implemented as a whole. The hydraulic tank is preferably a flow-optimized and/or volume-reduced tank so that only a small footprint is required; for example, a tank with at least two bypasses of respectively 180° may be used. For example, it may arise that at least one recess, such as a cavity, is present in a surface of the hydraulic tank, said recess for example corresponding to at least one flow guidance geometry arranged in the interior, wherein preferably at least one attachment such as a cooling pump or the like and/or a part thereof is inserted into the recess in a space-saving manner.

Preferably at least one hydraulic pump and at least one drive motor are at least directly coupled in the pump subassembly, so that savings may be made relative to the coupling. Advantageous embodiments save further installation space and costs, such as a partially integrated design in which, for example, a pump shaft is received in a hollow shaft of a drive motor or a drive motor shaft is received in a hollow shaft of a pump or even a fully integrated design in which, for example, the pump and motor are provided in a common housing. In principle, any drive technology is able to be used. Asynchronous motor technology is particularly reliable for the drive motor. A particularly high energy density and/or a particularly low overall height is achieved with a drive motor in preferred synchronous motor technology. A water-cooled synchronous motor is also more energy dense and/or smaller in terms of overall height.

The fluid supply region, also called the hydraulic region, in addition to the at least one pump subassembly and the at least one hydraulic tank may contain further parts and/or subassemblies, such as for example a filter subassembly, which may be fluidically connected in parallel and/or in series to a consumer circuit, and/or for example a cooling subassembly such as a cooler subassembly which is actively and/or passively cooled by air and/or water and connected to the consumer circuit in parallel and/or in series.

A base defining the fluid supply region on the bottom face may be designed as the basis of the hydraulic unit, wherein the base is preferably a part of the hydraulic unit which may be displaced relative to the surroundings, such as a factory workshop. If the pump subassembly and the hydraulic tank are connected in a parallel circuit to the base, a construction which is simple as a whole is possible. The pump subassembly and the hydraulic tank may be arranged and/or fixed to a common base.

If the pump subassembly and/or the hydraulic tank is/are rigidly connected to the base which is designed as a block base and which defines the fluid supply region on the bottom face, this advantageously alters the natural frequency of this connection and/or of the hydraulic unit, so that it may arise that as a whole less sound is emitted and/or sound in bandwidths which are regarded as having less interference.

A block base may be a base designed according to the principle of large inertial mass. Alternatively, a sprung, damped and/or floating bearing of the pump subassembly and/or of the tank may be provided on a base by the interposition of at least one or at least one respective resilient and/or damping element in order to satisfy customer requirements.

With regard to significant vibration damping behavior it is preferred if the base contains a polymer concrete and/or consists thereof. A polymer concrete may be defined as a composite material comprising at least concrete and polymer fibers as well as optionally at least one metal component, such as a steel semi-finished product, and/or at least one further additive.

For reducing the emissions, the base and the housing portion may sealingly surround the fluid supply region at least on the bottom face and on the outer face. As a development, the fluid supply region may also be sealingly surrounded on the upper face by the housing portion. The emissions to be reduced may, for example, be an emission of sound, an emission of leakage fluid and/or the like.

Thus, for example, it may be provided that the base together with the housing portion surrounding the fluid supply region is shaped as a fluid collection trough so that a leakage fluid flow which is present under pressure may also be collected directly in a reliable manner. For example, it may be provided that the housing portion contains sound-damping plate elements. For example, it may be provided that the housing portion and the base are joined in a fluid-tight manner.

If the base is shaped as a fluid collection trough, hydraulic fluid which escapes may be directly collected. For example, the base is configured to be concave on the upper face. In this case, the base may preferably be dimensioned at least for receiving a leakage fluid flow and even more preferably for receiving a volume corresponding to a hydraulic circuit and/or the tank. Additionally or alternatively, the base is provided with a transfer interface for a separate fluid collection trough. These features may facilitate and/or permit the fulfillment of legal requirements, for example the German Water Management Act.

Preferably, the controller region contains an electric controller region and a fluid circuit installation space. The electric controller region preferably contains an electrical energy supply of the hydraulic unit and/or an electronic controller of the hydraulic unit. The term electronic controller may be understood and/or summarized as a unit-related control device, for example a control appliance such as a memory programmable controller, a component-related control device, for example a driver for an actuator or an evaluation unit for a sensor, a communication device, for example a network connection, an input and/or output device, for example a human-machine interface such as a touch-sensitive screen, or the like. The fluid circuit installation space is preferably an installation space which is provided for accommodating an application-specific fluid circuit.

For facilitating serviceability it may be provided that the fluid supply region and an electric controller region provided in the controller region are arranged on the same unit side. For example, therefore, a change of filter such as an oil filter in the fluid supply region and an air filter in the housing portion of the electric controller region may be facilitated. In a development, it may be provided that the fluid supply region and the electric controller region have on the same unit side at least one respective openable housing part, such as a door, or a common openable housing part. This unit side is preferably designed as a front face of the hydraulic unit; for example this unit side may contain operating elements and/or operating connections; thus savings may be made to the footprint by a surface having to be provided on only one unit side for access by an operator.

It is also a development or independently claimable to connect and/or to switch fluidically the fluid supply region and a fluid circuit installation space provided in the controller region by a terminal block. The terminal block is preferably provided on the fluid circuit installation side with at least one interface for at least any fluid circuit. Advantageously, the interface is configured for connecting at least one standardized circuit component and/or for connecting at least one hydraulic line, such as at least one supply line and/or at least one return line to/from a consumer. The interface preferably contains an approximately horizontal bearing surface for a fluid circuit in a vertical layered design, wherein individual circuit elements are layered on top of one another in one respective housing block in order to permit a reconfiguration of the fluid circuit by simple means. Particularly preferably, the terminal block is designed in the form of a valve block as a circuit unit which receives at least one pressure limiting unit, at least one non-return unit which blocks fluid from the fluid circuit to the pump subassembly, at least one pressure filter unit and/or at least one sensor unit, such as at least one temperature sensor unit, at least one pressure sensor unit and/or at least one volumetric flow sensor unit. It is advantageous if the terminal block contains at least one, preferably electronic, interface for communicating with an electronic controller. Preferably, the terminal block extends approximately horizontally in order to be able to be assembled in a simple manner. In an exemplary configuration, wherein the fluid supply region is arranged at the bottom to the front and the fluid circuit region is arranged at the top to the rear, the terminal block extends therebetween approximately horizontally, for example also via the hydraulic tank, in order to connect together the fluid regions in an easy to assemble manner. The terminal block may also be called a hydraulic block.

The housing contains at least the lower housing portion with the fluid supply region and the upper housing portion with the controller region. In addition to the base described above, the housing may contain further portions. The housing may be designed as a frame construction with load-bearing frame parts in order to be particularly accessible. The housing may be designed as a framework construction with load-bearing frame parts and wall parts fixed thereto in order to use optimized components in each case for receiving loads and/or for covering/screening. The housing may be designed as a self-supporting wall construction in order to reduce the number of parts, which in particular saves costs in the case of large quantities. The housing may be a mixed construction made up of a partially pure frame construction, framework construction and/or self-supporting wall construction, to fulfill different requirements in some regions. In this case "in some regions" is not necessarily to be interpreted as the "housing portions". Thus a mixed construction may use in each case self-supporting walls as the side walls and rear wall, which serve as a frame for at least one front removable wall or at least one door, in order to provide a simple access to the housing interior. A mixed construction may also contain self-supporting walls in a lower part and a framework construction in an upper part, which is constructed thereon, in order, for example, to prevent emissions in the lower housing portion even more effectively. At least one housing part, such as a frame part and/or a wall part and/or a door and/or the base, may preferably be provided on the housing inner face with damping, such as sound damping in order to reduce emissions further. Preferably, the housing parts are sealingly connected together, preferably at least around the fluid supply region, at least in order to inhibit an escape of fluid from the housing. Profiled rails are advantageously able to be used in order to achieve simple and rapid assembly, wherein said profiled rail(s) is/are preferably able to be used in the region of the terminal block and/or the fluid circuit installation space for coupling an application-specific fluid circuit and/or in the region of the electric circuit region for coupling an application-specific control appliance and/or, for example, an integrated switchbox and/or in the region of the housing outer face for coupling the hydraulic unit to an application-specific device. A frame part may be a profiled rail. A profiled rail may be a separate part, such as a semi-finished product, or a portion of a part, such as a groove of a wall part.

The hydraulic unit is preferably provided with at least one cool water interface with at least one inlet connection and at least one return connection, wherein just one interface is particularly preferred with just one inlet and just one return for a simple connection. The hydraulic unit further preferably comprises an internal cool water distribution device which divides the supplied cool water to the internal consumers, collects cool water therefrom and supplies cool water to the return. Cool water consumers may be a hydraulic fluid cooler, such as for example a tube bundle cooler, a counterflow cooler or a preferred plate cooler, a drive, such as a water-cooled synchronous motor or the like, a power electronics unit such as a driver and/or power amplifier, a transformer and/or a control appliance or the like. The hydraulic unit is preferably provided with at least one energy supply interface, wherein only one interface is particularly preferred. The hydraulic unit also preferably has an internal energy distribution device. The hydraulic unit is preferably provided with at least one data exchange interface. The hydraulic unit is preferably provided with at least one human-machine interface, wherein this interface is preferably attached to a front face of the housing, for example to a door. Particularly preferably, the hydraulic unit is provided with a human-machine-controller interface for controlling a control appliance and/or a human-machine-information interface for providing information to a user. An example of such a controller interface is a monitor with a keyboard or a touch-sensitive screen, or the like. An example of such an information interface is a status lamp designed for visualizing a hydraulic unit status, such as a lamp provided for emitting a red, a yellow and a green light, such as an RGB lamp or an RG lamp, such as an LED lamp.

A hydraulic unit with a housing is thus disclosed, wherein at the bottom in a fluid supply region a tank and a pump are arranged adjacent to one another and a controller region is arranged thereabove. Since the pump is configured in a upright design, a compact hydraulic unit with a small footprint is implemented.

In other words, a hydraulic unit is independently claimable, wherein a hydraulic tank is arranged in a housing in a lower part and a pump with a drive motor is arranged to the front thereof in an upright design. An electronic controller is able to be arranged thereabove and namely preferably offset diagonally and/or to the front relative to the hydraulic unit. In the space above the tank a fluid controller, such as for example at least one function block and/or at least one valve, may be preferably arranged in a vertical sequence. The housing may be formed by frame parts and/or wall parts. Moreover, a terminal block which, for example, may extend approximately over the depth of the unit, such as oriented from front to back, may be provided in the hydraulic unit. This terminal block may have in a front part hydraulic connectors for the pump and for a return to the tank and, for example, a filter which may be screwed in, for example. In a rear tank the terminal block may provide at least one upwardly facing connection surface for at least one valve and/or at least one control block.

BRIEF DESCRIPTION OF THE DRAWINGS

A preferred exemplary embodiment of the disclosure is described in more detail hereinafter with reference to schematic drawings, in which.

DETAILED DESCRIPTION

Figure 1:
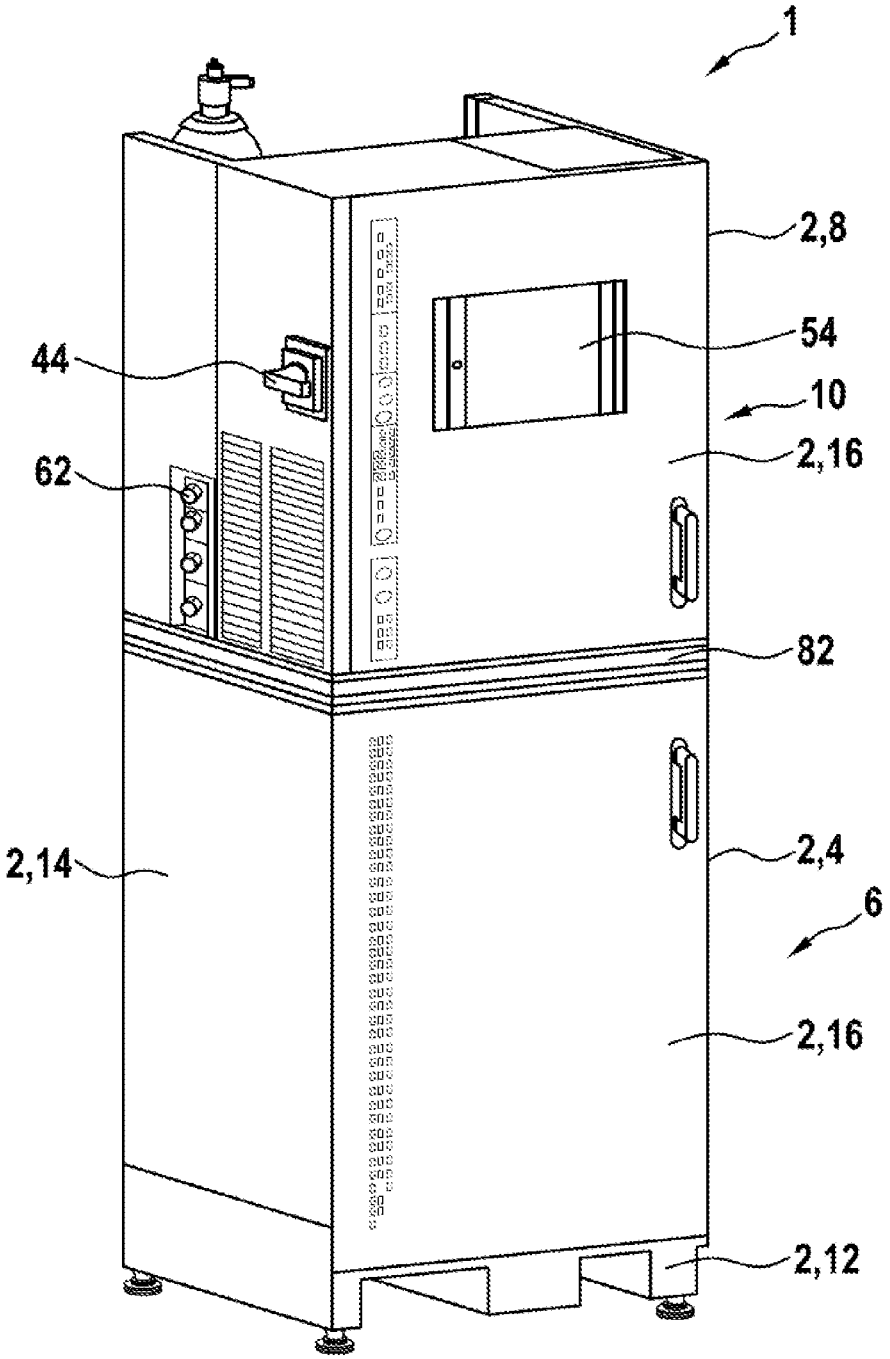
FIG. 1 shows a hydraulic unit according to the disclosure with a closed housing in a perspective view.

FIG. 1 shows a hydraulic unit 1 according to the invention for stationary operation, said hydraulic unit being received in a housing 2. The housing 2 receives in a lower housing portion 4 a fluid supply region 6 and/or hydraulic region and/or hydraulic unit and in an upper housing portion 8 a controller region 10.

Figure 2:
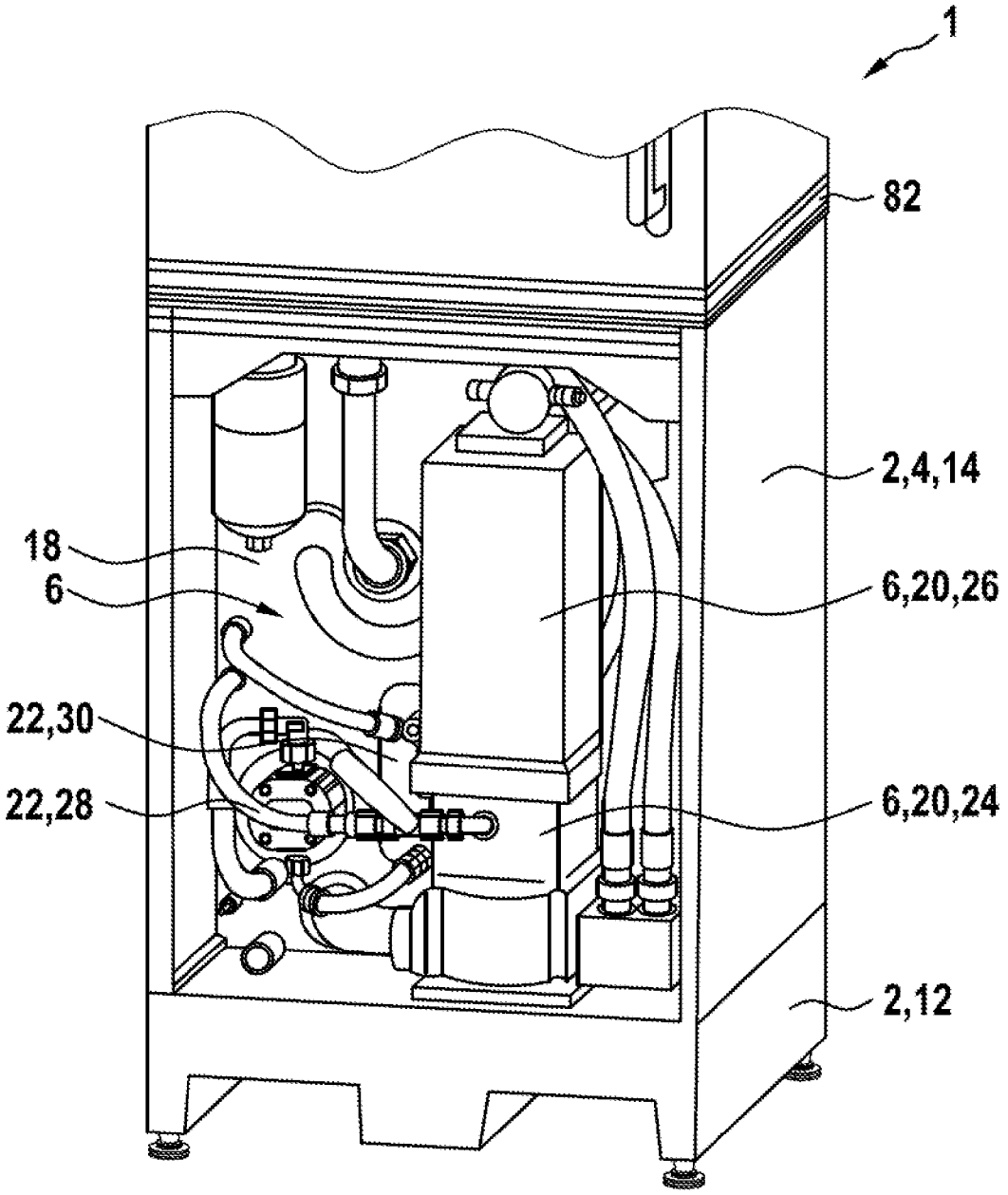
FIG. 2 shows a fluid supply region of the hydraulic unit with an open housing in a perspective view.

A base 12 and/or a base plate, which may be regarded as part of the housing 2, are designed and dimensioned from polymer concrete and as a collection trough and said base terminates the fluid supply region 6 on the bottom face. Self-supporting walls 14 with internal sound damping (not shown) adjoin the base 12 in the vertical direction to the side and to the rear in a fluid-tight manner, whilst a door 16 which also has internal sound damping is fastened at the front so as to be closed in a fluid-tight manner, see in particular FIG. 2.

A hydraulic tank 18, a pump subassembly 20 and/or hydraulic drive unit and a cooling subassembly 22 and/or cooler subassembly are accommodated in the fluid supply region 6 in a manner which saves space in terms of footprint. The hydraulic tank 18 in the present case is rigidly connected to the base 12. The hydraulic tank 18 has a design which is optimized in terms of flow and degassing and is designed to be of upright design, i.e. not lower than it is wide and deep so that it only requires a small footprint. The hydraulic tank 18 in the present case is designed as a tank subassembly which in addition to the tank as a container has a filling state display, a filling level sensor, a sensor interface, a suction interface, and a return line interface (none thereof being shown), which may all be provided optionally and independently of one another. The pump subassembly 20 comprises a pump 24 which is coupled rigidly to the base 12 in an upright design, i.e. also not lower than it is wide and deep, and it comprises a synchronous motor as a drive 26 coupled rigidly to the pump 24 in order to reduce the overall height and to increase the total inertial mass. The pump shaft is received in a hollow shaft of the motor (not shown). The cooling subassembly 22 is connected in parallel to the pump subassembly 20 and attached to the hydraulic tank 18 in a manner which is fluidically independent from a consumer circuit and/or pressure circuit. The cooling subassembly 22 comprises a cooling pump 28, the motor thereof being concealed in a space-saving manner in a flow-guidance geometry of the hydraulic tank 18, and a plate cooler 30 which is also partially concealed in a space-saving manner in a flow geometry of the hydraulic tank 18.

Figure 3:
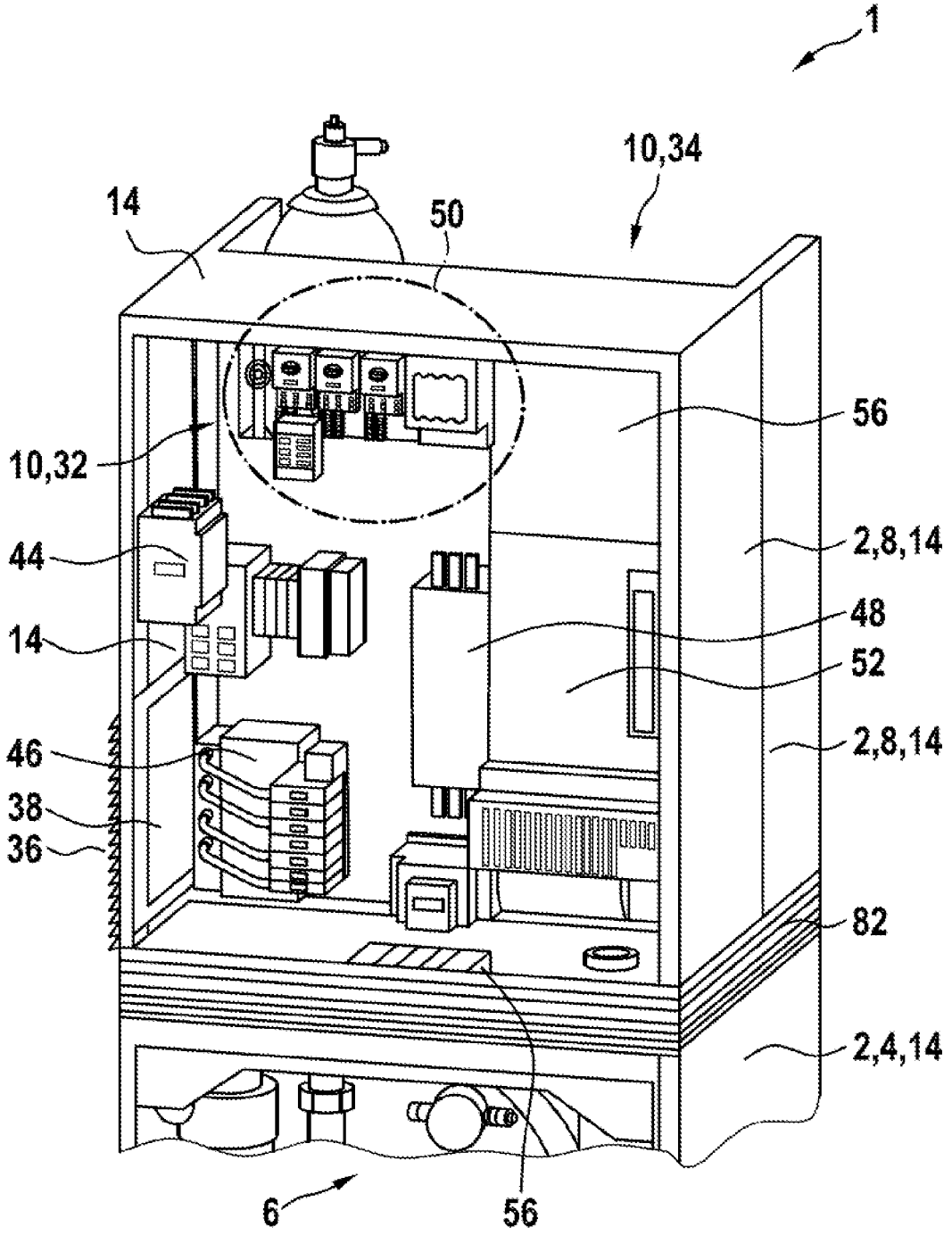
FIG. 3 shows a controller region of the hydraulic unit with an open housing in a perspective view.
Figure 4:
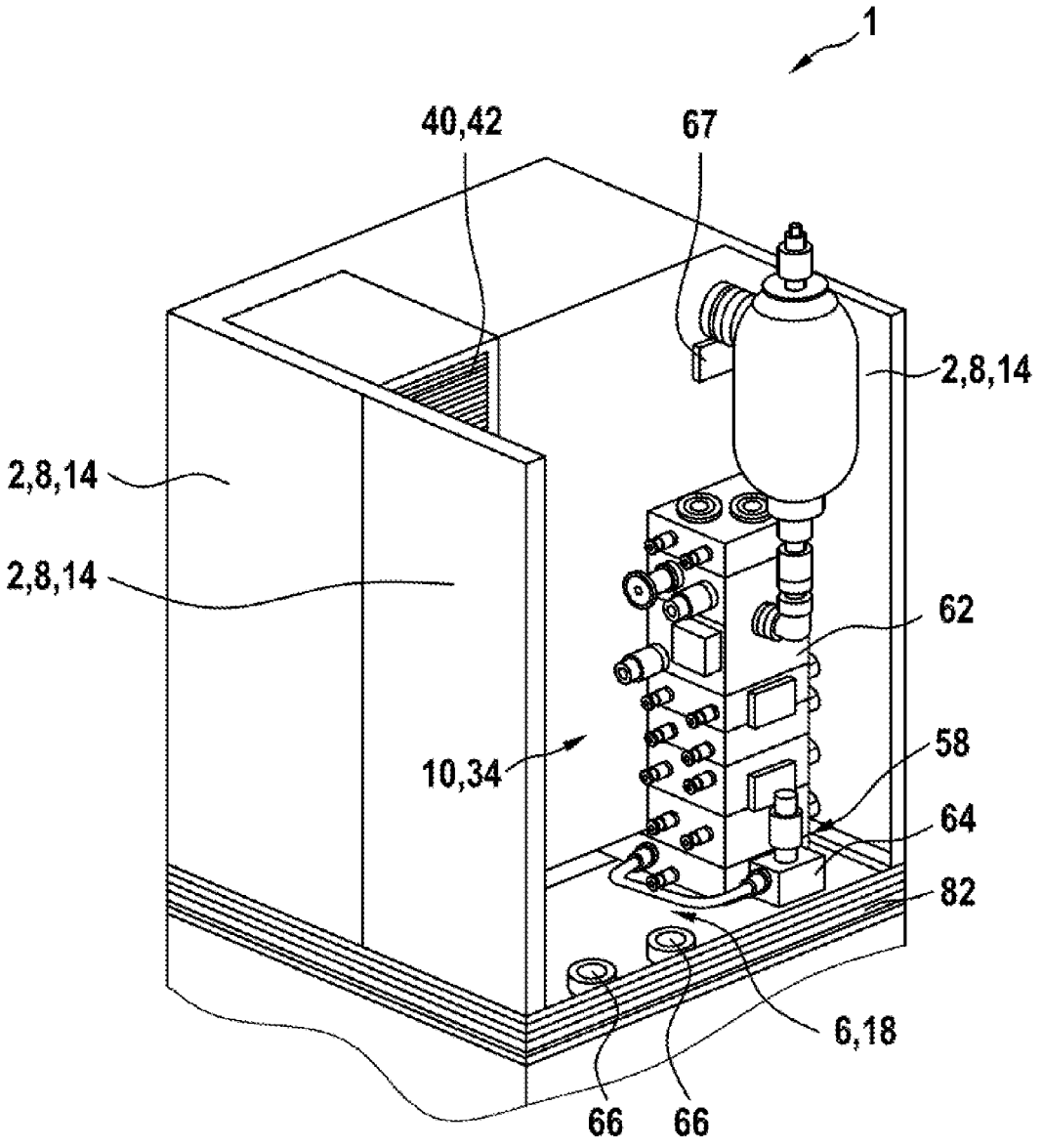
FIG. 4 shows the controller region with an open in a perspective view which is different from FIG. 3.

An electric controller region 32 and/or an electrical unit and/or a switchbox portion and a fluid circuit installation space 34 shown clearly in FIG. 4 and/or a region for an application-specific and/or customer-specific hydraulic controller, shown clearly in FIG. 3, are accommodated in the controller region 10.

The electric controller region 32 is enclosed in a dustproof manner by walls 14 and a door 16 arranged at the front, wherein an air inlet 36 with an air inlet filter 38 and an air outlet 40 with an internal air guidance geometry 56, such as at least one air guidance plate, and an air outlet filter 42 are arranged on approximately diagonally opposing housing portions in the walls 14. A main switch 44, a power supply choke 46, a network filter 48, electronic elements 50 for distribution and fuse protection, a drive controller 52 and on the aperture of the door 16 a touch-sensitive screen 54 as a human-machine interface are shown in the electric controller region 32 by way of example. At least one fluid-tight and dust-proof cable lead-in 56 through a wall 14 separating the fluid supply region 6 and the electric controller region 32 in a fluid-tight and dust-proof manner is also shown in FIG. 3, for example a motor power cable and/or a sensor cable being guided therethrough.

For easier accessibility the fluid circuit installation space 34 is partially open in the present case to the rear and to the top, wherein the walls 14 may be used as side cladding. Access to the fluid controller 62 is possible through an aperture in a lateral wall 14 in the present case, see FIG. 1. An interface 58 of a terminal block 60 facing upwardly leads into the fluid circuit chamber 34 on the bottom face. The interface 58 in the present case is configured for the approximately vertical installation of a customer-specific and/or application-specific fluid controller 62 and/or such a control block and/or valve block in a segmented block design according to, for example, the design IH20. This design is only one preferred example of an interface 58 which is compliant with regulations. In addition to the fluid controller 62 in the fluid circuit installation space 34 a degassing unit 64 for active air bubble removal in and out of the hydraulic tank 18 is attached to the terminal block 60. In the present case, optionally additional connections 66 lead to and from the hydraulic tank 18 on the bottom face into the fluid circuit installation space 34. At least one electrical interface 67 connects the two regions 32, 34 through a wall 14 between the electric controller region 32 and the fluid circuit installation space 34.

In the view of FIG. 4 the fluid supply region 6 with the hydraulic tank 18 may be identified on the bottom face, but optionally a fluid-tight terminating wall may be arranged so as to terminate the fluid supply region 6 at the top and/or the fluid circuit installation space 34 at the bottom; this wall which terminates the fluid circuit installation space 34 at the bottom in a fluid-tight manner is preferably designed for collecting leakage oil and for the transfer thereof to the hydraulic tank 18, to an upper face of the base 12 and/or the like. As an alternative, as may be identified in the side view of FIG. 5, an upper face of the hydraulic tank may be designed with a leakage guide geometry 68, for example obliquely and/or as an outlet.

Figure 5:
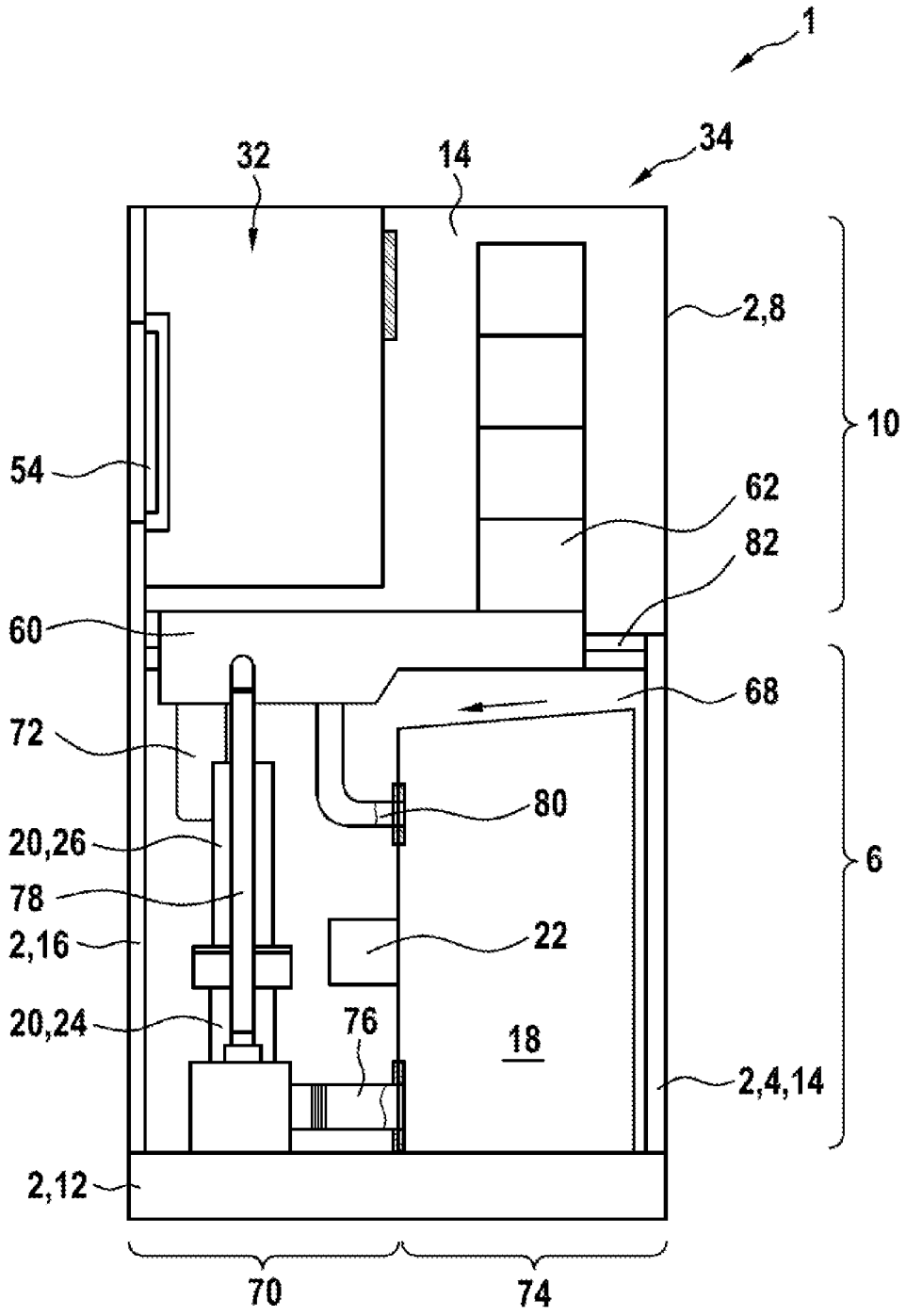
FIG. 5 shows a schematic longitudinal section through the hydraulic unit.

FIG. 5 shows in the sectional side view a principal construction of the hydraulic unit 1. In this case, a fluid supply region 6 which is arranged at the bottom and a controller region 10 which is arranged thereabove and/or at the top are defined by respective housing portions 4, 8. In each case in a front region 70, i.e. on a front unit side, the pump subassembly 20 and the cooling subassembly 22, the electric controller region 32 and the terminal block 60 therebetween, in particular by way of example a filter 72 screwed therein, are arranged so as to be accessible via doors 16. The screen 54 is also accessible from the front. The hydraulic tank 18 and the fluid circuit installation space 34 are arranged to the rear thereof in each case in a rear region 74, i.e. on a rear unit side. In the side view of FIG. 5 in the front part of the fluid supply region a suction line 76 leading from the hydraulic tank 18 to the pump 24, a pressure connection 78, such as a hose, leading from the pump 24 to the terminal block 60 and a return 80 leading from the terminal block 60 to the hydraulic tank 18 are also shown.

Figure 6:
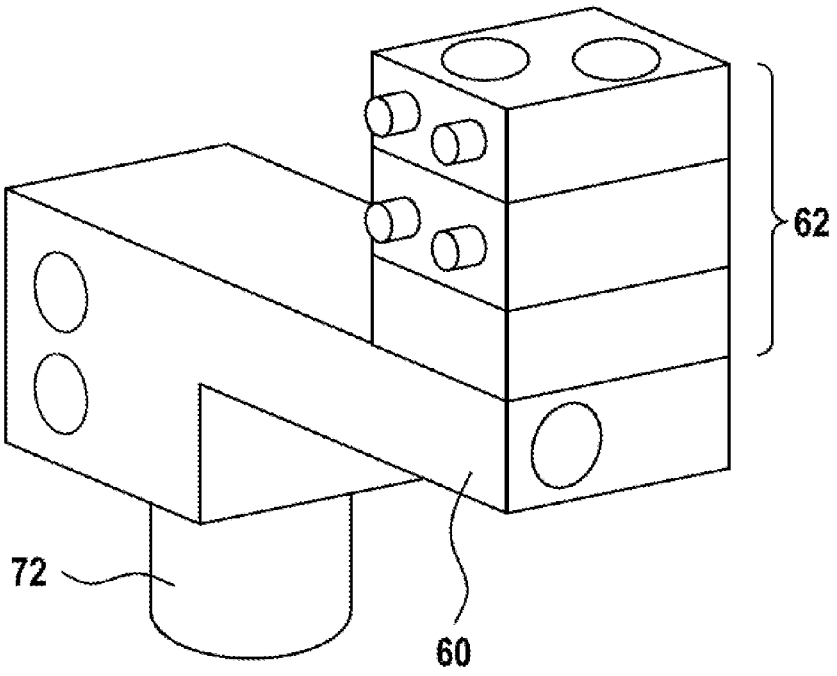
FIG. 6 shows a terminal block with attachments in a perspective view.

The terminal block 60 has lateral connections which are downwardly oriented and/or at least able to be reached from below in terms of assembly technology at one end in the front region 70 and lateral connections which are upwardly oriented and/or at least able to be reached from above in terms of assembly technology at one end in the rear region 74. For improved understanding of the design of the terminal block 60 this is shown in a variant in FIG. 6 with an attached filter 72 and an attached three-part fluid controller 62.

In the present case the housing 2 is designed as a combined construction. The basis forms the base 12 which is mounted on height-adjustable feet. The lower housing portion 4 with self-supporting walls 14 and a door 16 are constructed on the base 12. Alternatively, in the lower housing portion 4 frame parts 82, such as profiled bars, may also be used. In the present case, profiled bars in the manner of semi-finished products are constructed as frame parts 82 on the lower housing portion, said frame parts in the present case forming a layer which is advantageously suitable for coupling/attaching further elements. Via the frame parts 82, the upper housing portion 8 is formed by further walls 14, wherein the electric controller region 32 is enclosed on all sides by walls 14 and a door 16, whilst in the present case the fluid controller installation space 32 is only defined at the side by walls 14. This construction has many advantageous properties. For example, the pump subassembly 20 is enclosed in a fluid-tight and sound-damping manner at least on five sides and preferably on six sides so that emissions are reduced; in other words, they may be substantially enclosed and thus well sound-proofed.

Moreover, the electric controller region 32 may be heated directly by the air outlet 40 at the top. Hydraulic consumer connections (not shown) on the fluid controller 62 are freely accessible from the rear face and in a manner which is spatially separate from operating elements, so that changing the fluid controller 62 may be undertaken without reconfiguring the housing 2. In the present case, the hydraulic unit is a compact unit which, in particular, effectively utilizes a space which is available on its footprint and/or standing surface in the vertical direction and thus fulfills the requirements of a modern factory workshop in a cost-effective manner.

LIST OF REFERENCE NUMERALS

1 Hydraulic unit
2 Housing
4 Housing portion
6 Fluid supply region
8 Housing portion

10 Controller region
12 Base
14 Wall
16 Door
18 Hydraulic tank
20 Pump subassembly
22 Cooling subassembly
24 Pump
26 Drive
28 Cooling pump
30 Plate cooler
32 Electric controller region
34 Fluid circuit installation space
36 Air inlet
38 Air inlet filter
40 Air outlet
42 Air outlet filter
44 Main switch
46 Power supply choke
48 Network filter
50 Electronic elements
52 Drive controller
54 Screen
56 Cable lead-in
58 Interface
60 Terminal block
62 Fluid controller
64 Degassing unit
66 Additional connections
67 Electrical interface
68 Leakage guide geometry
70 Front region
72 Filter
74 Rear region
76 Suction line
78 Pressure connection
80 Return
82 Frame part

The invention claimed is:

1. A hydraulic unit comprising:
a fluid supply region arranged in a first housing portion;
a controller region arranged in a second housing portion located above the first housing portion;
at least one hydraulic tank arranged in the first housing portion;
a wall configured to isolate the first housing portion fluid supply region from the second housing portion; and
at least one pump subassembly arranged in the first housing portion adjacent to the at least one hydraulic tank,
wherein the at least one pump subassembly is oriented upright, such that a greatest extent of the at least one pump subassembly is vertical.

2. The hydraulic unit according to claim 1, wherein:
the at least one pump subassembly comprises a hydraulic pump directly coupled to a drive motor, and
a main axis of the hydraulic pump and the drive motor is vertical.

3. The hydraulic unit according to claim 1, wherein:
the fluid supply region is defined on a bottom face by a base,
the at least one pump subassembly and the at least one hydraulic tank are connected in a parallel circuit, and
the at least one pump subassembly and the at least one hydraulic tank are connected to the base.

4. The hydraulic unit according to claim 3, wherein:
the base is configured as a block base,
the at least one pump subassembly is rigidly connected to the base.

5. The hydraulic unit according to claim 3, wherein the base includes a polymer concrete.

6. The hydraulic unit according to claim 3, wherein the base and the first housing portion sealingly surround the fluid supply region at least on the bottom face and on an outer face.

7. The hydraulic unit according to claim 3, wherein the base is shaped as a fluid collection trough.

8. The hydraulic unit according to claim 1, wherein the fluid supply region and an electric controller region provided in the controller region are arranged on a common side of the hydraulic unit.

9. The hydraulic unit according to claim 1, wherein the fluid supply region and a fluid circuit installation space in the controller region are fluidly connected and/or interconnected by a terminal block.

10. The hydraulic unit according to claim 1, further comprising:
a housing including the first and second housing portions and formed by at least one frame part.

11. A hydraulic unit comprising:
a fluid supply region arranged in a first housing portion;
a controller region arranged in a second housing portion located above the first housing portion;
at least one hydraulic tank arranged in the fluid supply region; and
at least one pump subassembly arranged in the fluid supply region adjacent to the at least one hydraulic tank,
wherein the at least one pump subassembly is oriented upright, such that a greatest extent of the at least one pump subassembly is vertical,
wherein the at least one pump subassembly comprises a hydraulic pump operably connected to a drive motor,
wherein the fluid supply region is defined on a bottom face by a base, and
wherein the drive motor is spaced apart from the base by the hydraulic pump.

12. A hydraulic unit comprising:
a fluid supply region arranged in a first housing portion;
a controller region arranged in a second housing portion located above the first housing portion;
at least one hydraulic tank arranged in the first housing portion;
at least one pump subassembly arranged in the first housing portion and operably connected to the at least one hydraulic tank; and
a wall located between the first housing portion and second housing portion and configured to isolate the first housing portion fluid supply region from the second housing portion,
wherein the at least one pump subassembly is oriented upright.

13. The hydraulic unit according to claim 12, wherein:
the at least one pump subassembly comprises a hydraulic pump directly coupled to a drive motor, and
a main axis of the hydraulic pump and the drive motor is vertical.

14. The hydraulic unit according to claim 12, wherein:
the fluid supply region is defined on a bottom face by a base,
the at least one pump subassembly and the at least one hydraulic tank are connected in a parallel circuit, and
the at least one pump subassembly and the at least one hydraulic tank are connected to the base.

15. The hydraulic unit according to claim 14, wherein:

the base is configured as a block base, the at least one pump subassembly is rigidly connected to the base.

16. The hydraulic unit according to claim 14, wherein the base includes a polymer concrete.

17. The hydraulic unit according to claim 14, wherein the base and the first housing portion sealingly surround the fluid supply region at least on the bottom face and on an outer face.

18. The hydraulic unit according to claim 14, wherein the base is shaped as a fluid collection trough.

19. The hydraulic unit according to claim 12, wherein the fluid supply region and an electric controller region provided in the controller region are arranged on a common side of the hydraulic unit.

* * * * *